US007270181B2

(12) United States Patent
Pluchek et al.

(10) Patent No.: US 7,270,181 B2
(45) Date of Patent: Sep. 18, 2007

(54) DOWNHOLE SURGE PRESSURE REDUCTION AND FILTERING APPARATUS

(75) Inventors: Clayton Stanley Pluchek, Spring, TX (US); Gerald Dean Pedersen, Houston, TX (US); Richard Lee Giroux, Katy, TX (US); Thad Joseph Scott, Houston, TX (US); David Michael Haugen, League City, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/245,494

(22) Filed: Oct. 7, 2005

(65) Prior Publication Data

US 2006/0032634 A1 Feb. 16, 2006

Related U.S. Application Data

(62) Division of application No. 10/863,165, filed on Jun. 8, 2004, now Pat. No. 6,966,375, which is a division of application No. 10/324,412, filed on Dec. 20, 2002, now Pat. No. 6,755,252, which is a division of application No. 09/524,180, filed on Mar. 13, 2000, now Pat. No. 6,571,869.

(51) Int. Cl.
*E21B 43/08* (2006.01)
*E21B 43/10* (2006.01)
*E21B 33/14* (2006.01)

(52) U.S. Cl. ..... 166/285; 166/157; 166/177.4; 166/205; 166/227; 166/236; 166/242.8

(58) Field of Classification Search ..... 166/285, 166/177.4, 242.3, 242.8, 236, 227, 157, 205; 175/316, 314

See application file for complete search history.

(56) References Cited

U.S. PATENT DOCUMENTS

| | | | | |
|---|---|---|---|---|
| 436,889 | A * | 9/1890 | Coffin | 166/205 |
| 1,502,696 | A * | 7/1924 | Thomson | 166/158 |
| 1,572,022 | A * | 2/1926 | King | 166/105.1 |
| 1,839,044 | A | 12/1931 | Minyard | |

(Continued)

FOREIGN PATENT DOCUMENTS

| | | |
|---|---|---|
| EP | 0 617 195 | 9/1994 |

(Continued)

OTHER PUBLICATIONS

EP Office Action, Application No. 04 105 609.4-1266, dated Dec. 20, 2005.

(Continued)

*Primary Examiner*—Hoang Dang
(74) *Attorney, Agent, or Firm*—Patterson & Sheridan, L.L.P.

(57) ABSTRACT

The present invention provides a downhole cementing apparatus run into a borehole on a tubular. The apparatus is constructed on the pipe in such a way that pressure surge during run-in is reduced by allowing fluid to enter the pipe and utilize the fluid pathway of the cement. In one aspect of the invention, an inner member is provided that filters fluid as it enters the fluid pathway. In another aspect of the invention, various methods are provided within the cementing apparatus to loosen and displace sediment in the borehole prior to cementing.

17 Claims, 15 Drawing Sheets

U.S. PATENT DOCUMENTS

| | | | | | |
|---|---|---|---|---|---|
| 1,915,136 | A | * | 6/1933 | Share | 175/314 |
| 1,964,264 | A | | 6/1934 | Mack | |
| 2,090,545 | A | | 8/1937 | Moore | |
| 2,190,407 | A | | 2/1940 | King | |
| 2,214,550 | A | | 9/1940 | Edwards | |
| 2,291,371 | A | * | 7/1942 | Buchanan et al. | 166/290 |
| 2,335,578 | A | | 11/1943 | Carter | |
| 2,340,481 | A | | 2/1944 | Lloyd et al. | |
| 2,781,774 | A | | 2/1957 | Baker et al. | |
| 2,978,033 | A | | 4/1961 | Pitcher et al. | |
| 3,001,585 | A | * | 9/1961 | Shiplet | 166/142 |
| 3,123,517 | A | | 3/1964 | Davis | |
| 3,166,132 | A | * | 1/1965 | Lenahan et al. | 175/235 |
| 3,277,962 | A | * | 10/1966 | Flickinger et al. | 166/278 |
| 3,302,722 | A | | 2/1967 | Madeley, Sr. | |
| 3,664,421 | A | | 5/1972 | Urbanosky | |
| 3,760,878 | A | | 9/1973 | Peevey | |
| 3,895,678 | A | | 7/1975 | Wright et al. | |
| 4,190,113 | A | | 2/1980 | Harrison | |
| 4,760,884 | A | | 8/1988 | Haugen et al. | |
| 4,791,992 | A | | 12/1988 | Greenlee et al. | |
| 4,856,590 | A | | 8/1989 | Caillier | |
| 5,234,055 | A | | 8/1993 | Cornette | |
| 5,295,537 | A | | 3/1994 | Trainer | |
| 5,327,960 | A | | 7/1994 | Cornette et al. | |
| 5,366,009 | A | | 11/1994 | Cornette et al. | |
| 5,526,884 | A | | 6/1996 | Lembcke | |
| 5,960,881 | A | | 10/1999 | Allamon et al. | |
| 6,966,375 | B2 | | 11/2005 | Pluchek et al. | |

FOREIGN PATENT DOCUMENTS

| | | |
|---|---|---|
| FR | 2 543 213 | 3/1983 |
| FR | 2 543 213 | 9/1984 |
| GB | 2 338 009 | 12/1999 |
| WO | WO92/16717 | 10/1992 |

OTHER PUBLICATIONS

Norwegian Office Action, Norwegian Patent Application No. 20023965, dated Sep. 26, 2005.

* cited by examiner

FIG. 13A
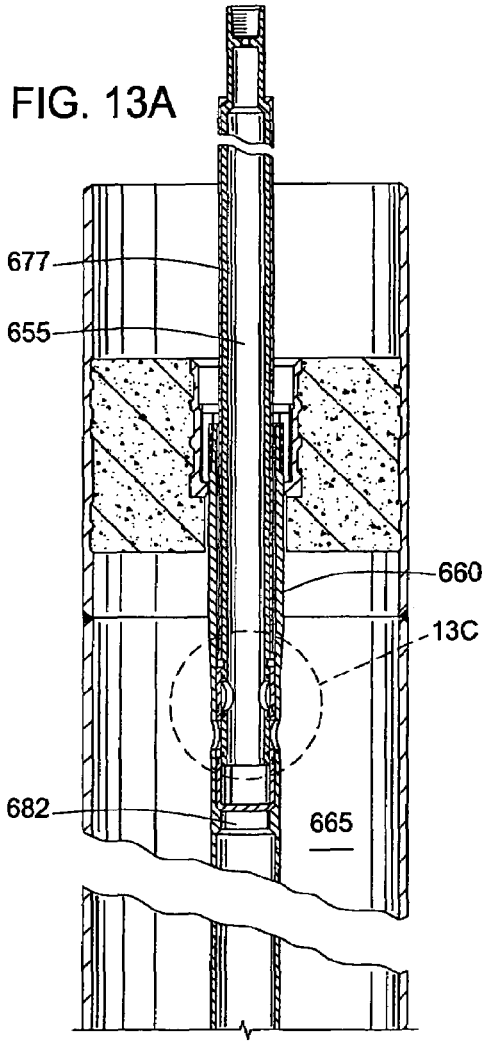
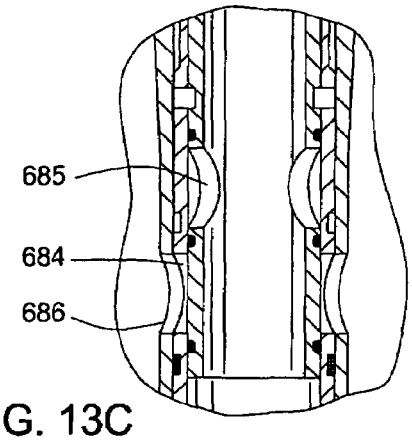
FIG. 13C
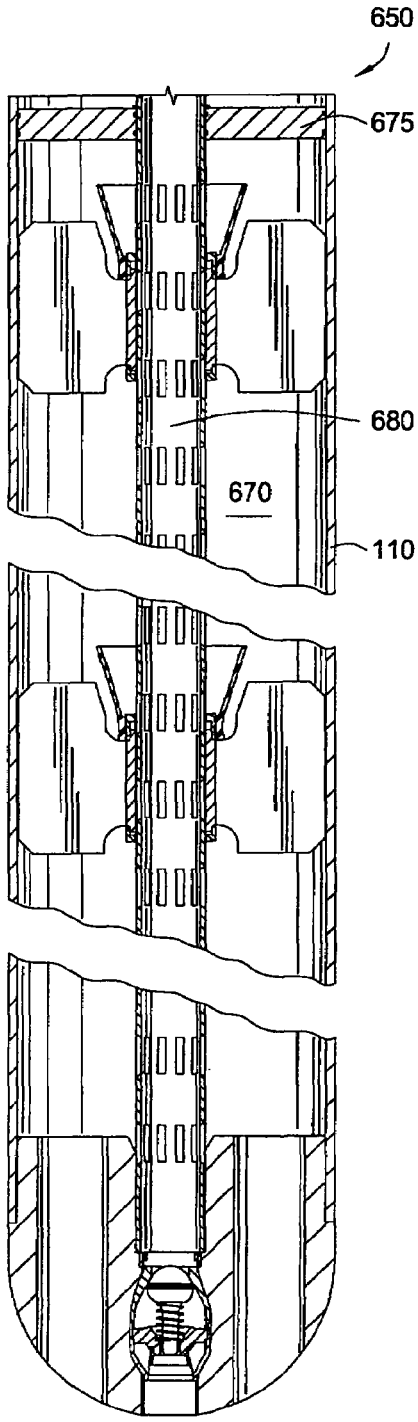
FIG. 13B

DOWNHOLE SURGE PRESSURE REDUCTION AND FILTERING APPARATUS

CROSS-REFERENCE TO RELATED APPLICATIONS

This application is a divisional of U.S. patent application Ser. No. 10/863,165, filed Jun. 8, 2004 now U.S. Pat. No. 6,966,375. U.S. patent application Ser. No. 10/863,165 is a divisional of U.S. patent application Ser. No. 10/324,412, filed Dec. 20, 2002, now U.S. Pat. No. 6,755,252. U.S. patent application Ser. No. 10/324,412 is a divisional of U.S. patent application Ser. No. 09/524,180 filed Mar. 13, 2000, now U.S. Pat. No. 6,571,869. Each of the aforementioned related patent applications is herein incorporated by reference in their entireties.

BACKGROUND OF THE INVENTION

1. Field of the Invention

The present invention provides a downhole surge pressure reduction apparatus for use in the oil well industry. More particularly, the invention provides a surge pressure reduction apparatus that is run into a well with a pipe string or other tubular to be cemented and facilitates the cementing by reducing surge pressure and inner well sediments during run-in.

2. Background of the Related Art

In the drilling of a hydrocarbon well, the borehole is typically lined with strings of pipe or tubulars (pipe or casing) to prevent the walls of the borehole from collapsing and to provide a reliable path for well production fluid, drilling mud and other fluids that are naturally present or that may be introduced into the well. Typically, after the well is drilled to a new depth, the drill bit and drill string are removed and a string of pipe is lowered into the well to a predetermined position whereby the top of the pipe is at about the same height as the bottom of the existing string of pipe (liner). In other instances, the new pipe string extends back to the surface of the well casing. In either case, the top of the pipe is fixed with a device such as a mechanical hanger. A column of cement is then pumped into the pipe or a smaller diameter run-in string and forced to the bottom of the borehole where it flows out of the pipe and flows upwards into an annulus defined by the borehole and pipe. The two principal functions of the cement between the pipe and the borehole are to restrict fluid movement between formations and to support the pipe.

To save time and money, apparatus to facilitate cementing are often lowered into the borehole along with a hanger and pipe to be cemented. A cementing apparatus typically includes a number of different components made up at the surface prior to run-in. These include a tapered nose portion located at the downhole end of the pipe to facilitate insertion thereof into the borehole. A check valve at least partially seals the end of the tubular and prevents entry of well fluid during run-in while permitting cement to subsequently flow outwards. Another valve or plug typically located in a baffle collar above the cementing tool prevents the cement in the annulus from back flowing into the pipe. Components of the cementing apparatus are made of plastic, fiberglass or other disposable material that, like cement remaining in the pipe, can be drilled when the cementing is completed and the borehole is drilled to a new depth.

There are problems associated with running a cementing apparatus into a well with a string of pipe. One such problem is surge pressure created as the pipe and cementing apparatus are lowered into the borehole filled with drilling mud or other well fluid. Because the end of the pipe is at least partially flow restricted, some of the well fluid is necessarily directed into the annular area between the borehole and the pipe. Rapid lowering of the pipe results in a corresponding increase or surge in pressure, at or below the pipe, generated by restricted fluid flow in the annulus. Surge pressure has many detrimental effects. For example, it can cause drilling fluid to be lost into the earth formation and it can weaken the exposed formation when the surge pressure in the borehole exceeds the formation pore pressure of the well. Additionally, surge pressure can cause a loss of cement to the formation during the cementing of the pipe due to formations that have become fractured by the surge pressure.

One response to the surge pressure problem is to decrease the running speed of the pipe downhole in order to maintain the surge pressure at an acceptable level. An acceptable level would be a level at least where the drilling fluid pressure, including the surge pressure is less than the formation pore pressure to minimize the above detrimental effects. However, any reduction of surge pressure is beneficial because the more surge pressure is reduced, the faster the pipe can be run into the borehole and the more profitable a drilling operation becomes.

The problem of surge pressure has been further addressed by the design of cementing apparatus that increases the flow path for drilling fluids through the pipe during run-in. In one such design, the check valve at the downhole end of the cementing apparatus is partially opened to flow during run-in to allow well fluid to enter the pipe and pressure to thereby be reduced. Various other paths are also provided higher in the apparatus to allow the well fluid to migrate upwards in the pipe during run-in. For example, baffle collars used at the top of cementing tools have been designed to permit the through flow of fluid during run-in by utilizing valves that are held in a partially open position during run-in and then remotely closed later to prevent back flow of cement. While these designs have been somewhat successful, the flow of well fluid is still impeded by restricted passages. Subsequent closing of the valves in the cementing tool and the baffle collar is also problematic because of mechanical failures and contamination.

Another problem encountered by prior art cementing apparatus relates to sediment, sand, drill cuttings and other particulates collected at the bottom of a newly drilled borehole and suspended within the drilling mud that fills the borehole prior to running-in a new pipe. Sediment at the borehole bottom becomes packed and prevents the pipe and cementing apparatus from being seated at the very bottom of the borehole after run-in. This misplacement of the cementing apparatus results in difficulties having the pipe in the well or at the wellhead. Also, the sediment below the cementing apparatus tends to be transported into the annulus with the cement where it has a detrimental effect on the quality of the cementing job. In those prior art designs that allow the drilling fluid to enter the pipe to reduce surge pressure, the fluid borne sediment can fowl mechanical parts in the borehole and can subsequently contaminate the cement.

There is a need therefore for a cementing apparatus that reduces surge pressure as it is run-into the well with a string of pipe. There is a further need, for a cementing apparatus that more effectively utilizes the flow path of cement to transport well fluid and reduces pressure surge during run-in. There is a further need for a cementing apparatus that filters sediments and particles from well fluid during run-in.

SUMMARY OF THE INVENTION

The present invention provides a downhole apparatus run into a borehole on pipe. The apparatus is constructed on or in a string of pipe in such a way that pressure surge during run-in is reduced by allowing well fluid to travel into and through the tool. In one aspect of the invention, an inner member is provided that filters or separates sediment from well fluid as it enters the fluid pathway. In another aspect of the invention, various methods are provided within the apparatus to loosen, displace or suction sediment in the borehole.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 6A is a section view of a plug at the end of a run-in string illustrating the flow of fluid through the plug during run-in.

FIG. 6D is a section view of a plug at the end of a run-in string illustrating the flow of fluid through the plug during run-in.

FIGS. 13A, B and C are section views showing the tool of the present invention with a remotely locatable, atmospheric chamber placed therein.

DETAILED DESCRIPTION OF THE PREFERRED EMBODIMENT

Figure 1A:
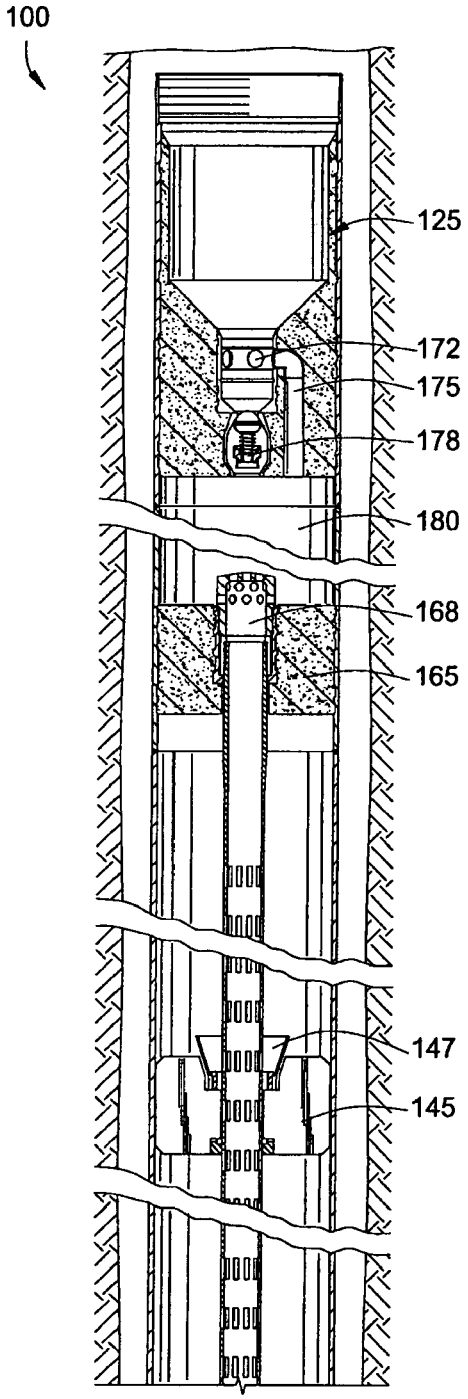
FIGS. 1A and B are section views of the tool of the present invention as it would appear in a borehole of a well.
Figure 9A:
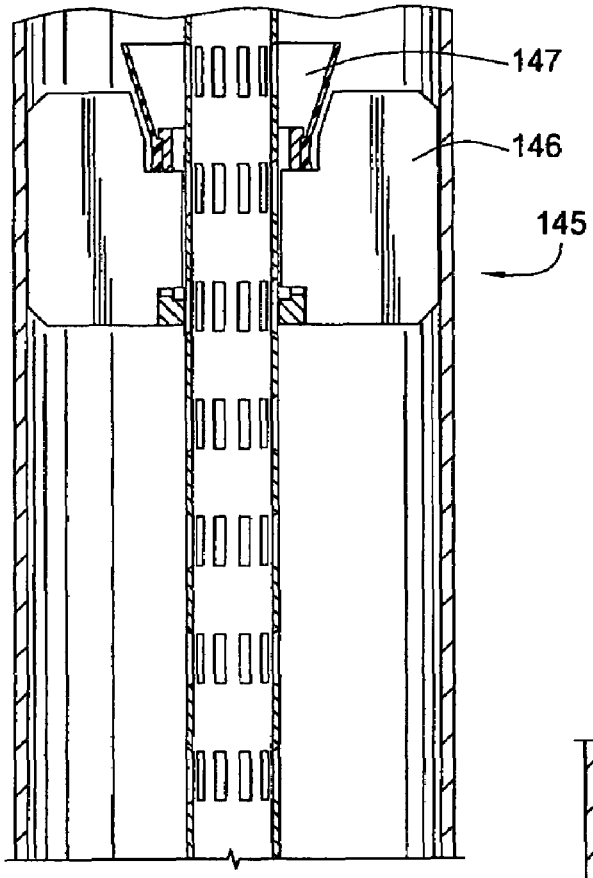
FIGS. 9A and B are enlarged views of the lower portion of the tool.
Figure 9B:
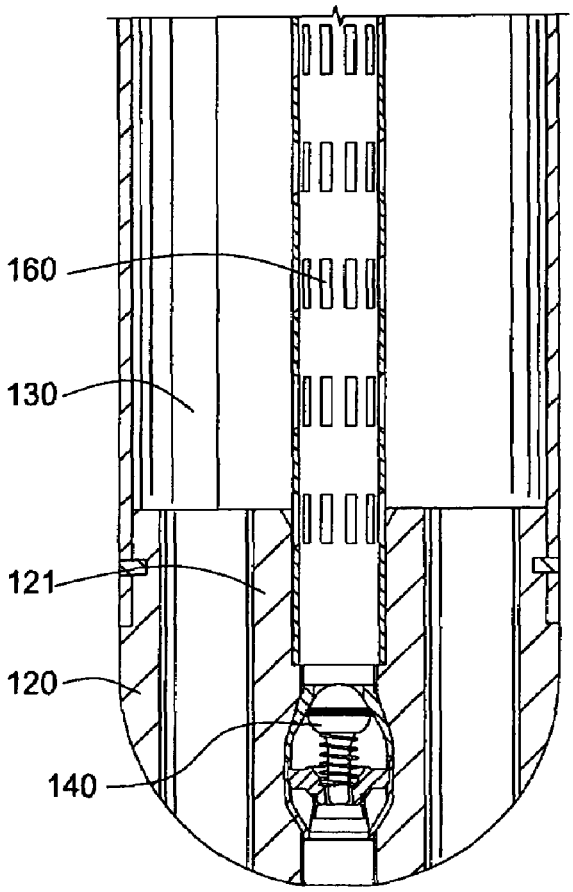

FIGS. 1A and B are section views showing the surge reduction and cementing tool 100 of the present invention. FIGS. 9A, B are enlarged views of the lower portion of the tool. In the Figures, the tool is depicted as it would appear after being inserted into a borehole 115. The tool 100 generally includes an outer body 110, an inner member 135 disposed within the outer body 110, a nose portion 120 and a baffle collar 125. Outer body 110 is preferably formed by the lower end of the pipe to be cemented in the borehole and the cementing tool 100 will typically be constructed and housed within the end of the pipe prior to being run-into the well. The terms "tubing," "tubular," "casing," "pipe" and "string" all relate to pipe used in a well or an operation within a well and are all used interchangeably herein. The term "pipe assembly" refers to a string of pipe, a hanger and a cementing tool all of which are run-into a borehole together on a run-in string of pipe. While the tool is shown in the Figures at the end of a tubular string, it will be understood that the tool described and claimed herein could also be inserted at any point in a string of tubulars.

Figure 1B:
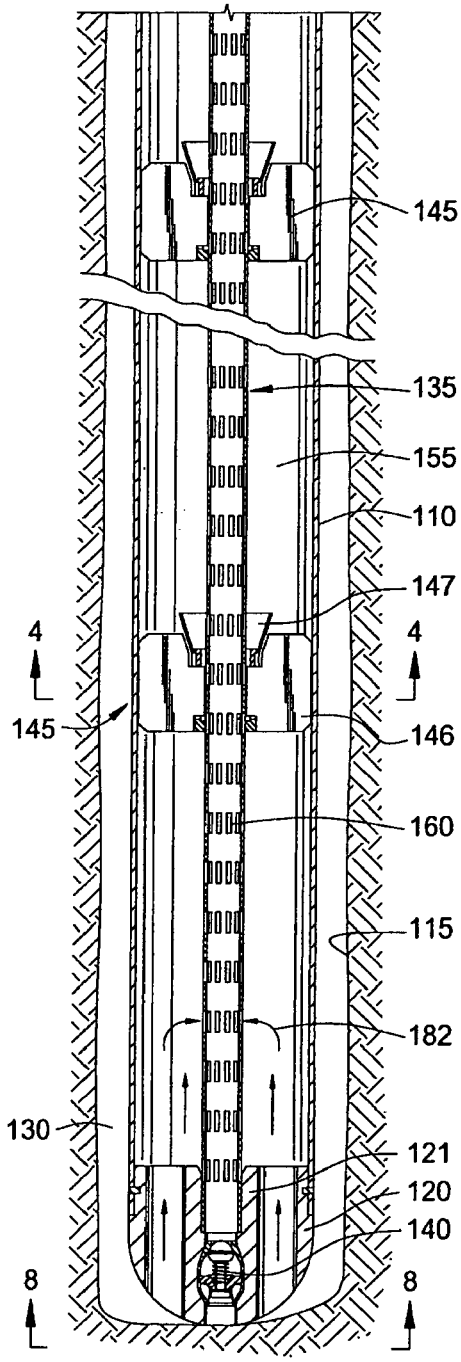
Figure 8:
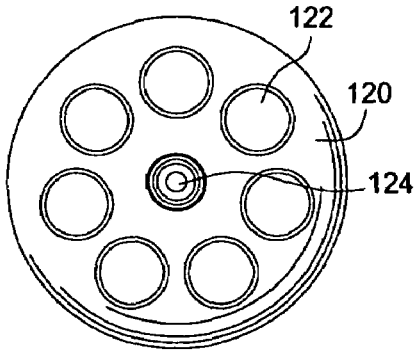
FIG. 8 is an end view showing the nose portion of the tool, taken along lines 8-8.

Nose portion 120 is installed at the lower end of outer body 110 as depicted in FIG. 1B to facilitate insertion of the tool 100 into the borehole 115 and to add strength and support to the lower end of the apparatus 100. FIG. 8 is an end view of the downhole end of the tool 100 showing the nose portion 120 with a plurality of radially spaced apertures 122 formed therearound and a center aperture 124 formed therein. Apertures 122 allow the inflow of fluid into the tool 100 during run-in and center aperture 124 allows cement to flow out into the borehole.

Centrally disposed within the outer body 110 is inner member 135 providing a filtered path for well fluid during run-in and a path for cement into the borehole during the subsequent cementing job. At a lower end, inner member 135 is supported by nose portion 120. Specifically, support structure 121 formed within nose portion 120 surrounds and supports the lower end of inner member 135. Disposed between the lower end of inner member 135 and nose portion 120 is check valve 140. The purpose of valve 140 is to restrict the flow of well fluid into the lower end of inner member 135 while allowing the outward flow of cement from the end of inner member as will be decried herein. As shown in FIG. 1B, check valve 140 is preferably a spring-loaded type valve having a ball to effectively seal the end of a tubular and withstand pressure generated during run-in. However, any device capable of restricting fluid flow in a single direction can be utilized and all are within the scope of the invention as claimed.

Figure 4:
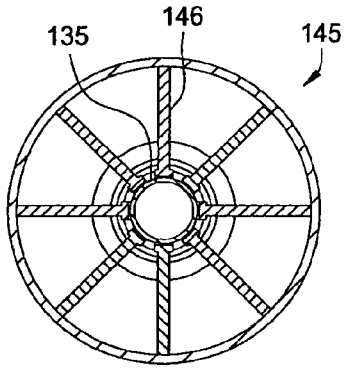
FIG. 4 is an end view of a centralizer located within the tool, taken along lines 4-4.

Along the length of inner portion 135 are a number of centralizers 145 providing additional support for inner member 135 and ensuring the inner member retains its position in the center of outer body 110. FIG. 4 is an end view of a centralizer 145 depicting its design and showing specifically its construction of radial spokes 146 extending from the inner member 135 to the inside wall of outer body 110, whereby fluid can freely pass though the annular area 155 formed between inner member 135 and outer body 110. Also visible in FIGS. 1A, 1B and 4 are funnel-shaped traps 147 designed to catch and retain sediment and particles that flow into the annular area 155, preventing them from falling back towards the bottom of the well. In the preferred embodiment, the sediment traps are nested at an upper end of each centralizer 145. Depending upon the length of the inner member 135, any number of centralizers 145 and sediment traps can be utilized in a tool 100.

Inner member 135 includes an inner portion formed therealong consisting of, in the preferred embodiment, perforations 160 extending therethrough to create a fluid path to the interior of the inner member 135. The perforations, while allowing the passage of fluid to reduce pressure surge, are also designed to prevent the passage of sediment or particles, thereby ensuring that the fluid traveling up the tool and into the pipe string above will be free of contaminants. The terms "filtering" and "separating" will be used interchangeably herein and both related to the removal, separation or isolation of any type of particle or other contaminate from the fluid passing through the tool. The size, shape and number of the perforations 160 are variable depending upon run-in speed and pressure surge generated during lowering of the pipe. Various materials can be used to increase or define the inner properties of the inner member. For example, the inner member can be wrapped in or have installed in a membrane material made of corrosive resistant, polymer material and strengthened with a layer of braided metal wrapped therearound. Additionally, membrane material can be used to line the inside of the inner member.

The upper end of inner member 135 is secured within outer body 110 by a drillable cement ring 165 formed therearound. Inner member 135 terminates in a perforated cap 168 which can provide additional filtering of fluids and, in an alternative embodiment, can also serve to catch a ball or other projectile used to actuate some device higher in the borehole. Between the upper end of inner member 135 and baffle collar 125 is a space 180 that provides an accumulation point for cement being pumped into the tool 100.

Figure 2:
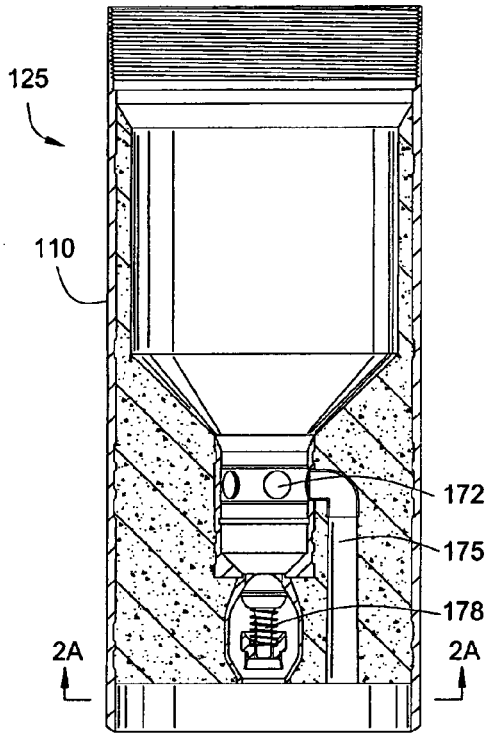
FIG. 2 is a section view showing a first embodiment of a baffle collar for use with the tool.
Figure 2A:
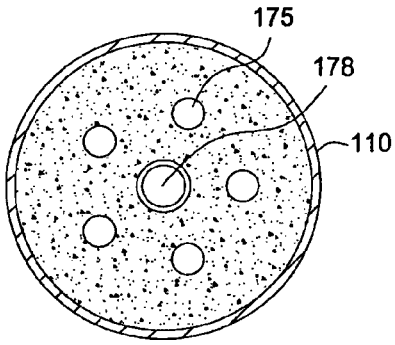
FIG. 2A is an end view of the baffle collar of FIG. 2, taken along lines 2A-2A.

At the upper end of tool 100 is a funnel-shaped baffle collar 125. In the preferred embodiment, the baffle collar provides a seat for a plug or other device which travels down the pipe behind a column of cement that is urged out the bottom of tool 100 and into the annulus 130 formed therearound. In the embodiment shown in FIG. 1A, the baffle collar is held within outer body 110 by cement or other drillable material. A mid-portion of baffle collar 125 includes by-pass holes 172 and by-pass channels 175 extending therefrom to provide fluid communication between the baffle collar 125 and space 180 therebelow. At a lower portion of the baffle collar 125 is a check valve 178 to prevent the inward flow of fluid into the baffle collar 125 while allowing cement to flow outward into the space 180 therebelow. During run-in, well fluid travels through channels 175. FIG. 2 is an enlarged section view showing the various components of the baffle collar. FIG. 2A is a section view showing the by-pass channels 175 and the placement of the check valve 178.

Figure 7:
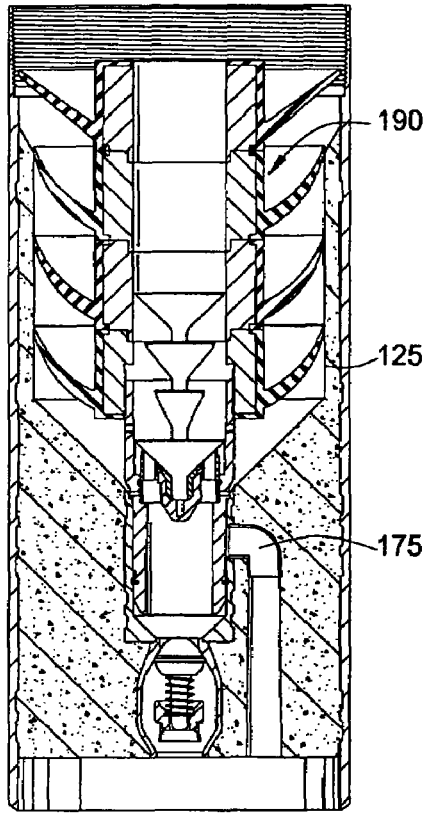
FIG. 7 is a section view showing a plug and dart assembly landed within a baffle collar and sealing channels formed therein.

FIG. 7 illustrates a plug and dart assembly 190, having landed in baffle collar 125 and sealed the fluid path of well fluid into the baffle collar through by-pass holes 172 and by-pass channels 175. In the preferred embodiment, after cement has been injected into the borehole and a dart has traveled down the run-in string and landed in the plug, the plug and dart assembly 190 are launched from the running string and urged downward in the pipe behind the column of cement that will be used to cement the pipe in the borehole 115. The plug and dart assembly 190 are designed to seat in the baffle collar 125 where they also function to prevent subsequent back flow of cement into the baffle collar 125 and the pipe (not shown) thereabove.

Figure 3:
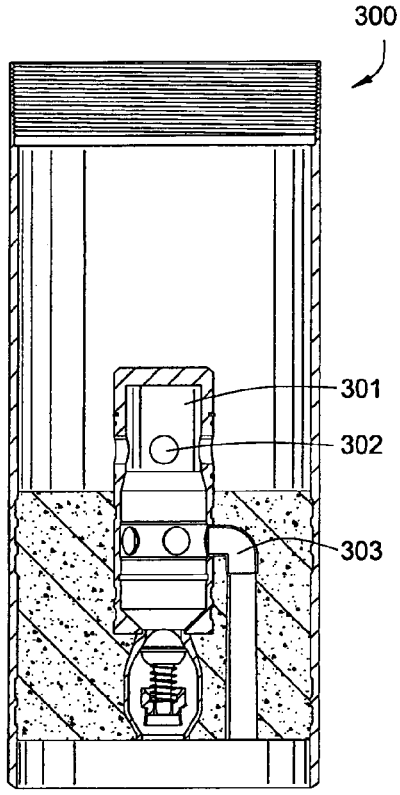
FIG. 3 is a section view showing a second embodiment of a baffle collar.

FIG. 3 is a section view showing an alternative embodiment of a baffle collar 300. In this embodiment, the upper portion of the baffle collar 300 forms a male portion 301 with apertures 302 in fluid communication with by-pass channels 303. Male portion 301 is received by a plug and dart having a mating female portion formed therein. In this manner, the apertures 302 in the male portion of the baffle collar are covered and sealed by the female portion of the plug and dart assembly (not shown).

Figure 5:
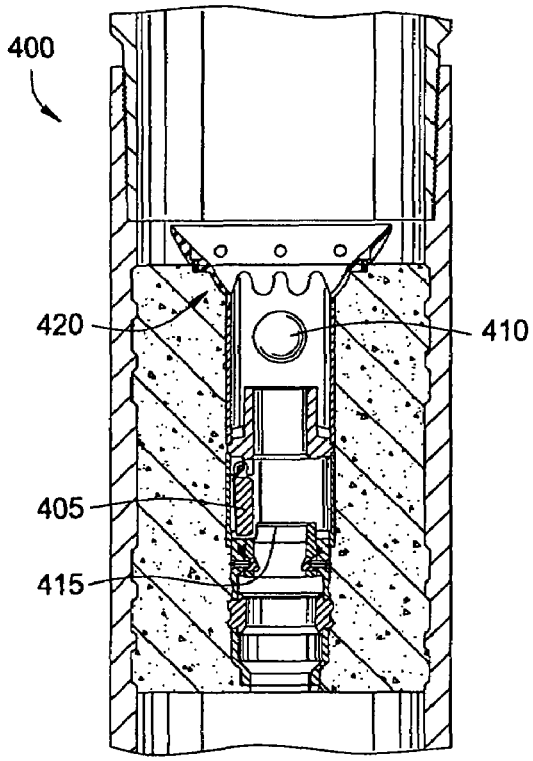
FIG. 5 is a section view showing a third embodiment of a baffle collar for use with the tool.

FIG. 5 illustrates a third embodiment of a baffle collar 400 for use in the tool of the present invention. In this embodiment, a flapper valve 405 is propped open during run-in to allow well fluid to pass through the baffle collar 400 to relieve surge pressure. Once the pipe has been run in into the well, the flapper valve 405 is remotely closed by dropping a ball 410 into a seat 415 which allows the spring-loaded flapper valve 405 to close. Thereafter, the baffle collar 400 is sealed to the upper flow of fluid while the flapper valve 405 can be freely opened to allow the downward flow of cement. In this embodiment, the plug and dart assembly (not shown) includes wavy formations which mate with the wavy 420 formations formed in the baffle collar 400. This embodiment is particularly useful anytime an object must be lowered or dropped into the cementing apparatus. Because it provides a clear path for a ball or other projectile into the cementing tool, baffle collar 400 is particularly useful with a remotely locatable portable atmospheric chamber described hereafter and illustrated in FIGS. 13A-C.

Figure 6A:
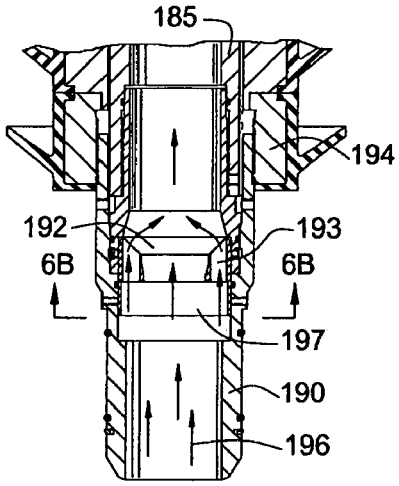
Figure 6D:
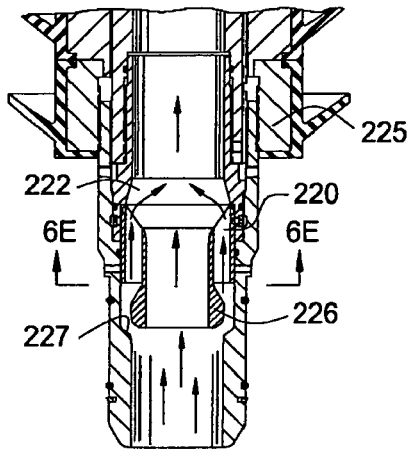
Figure 6B:
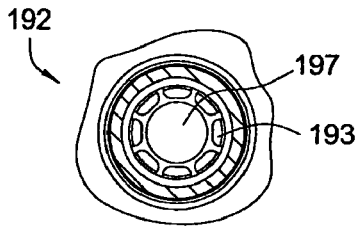
FIG. 6B is an end view of the plug of FIG. 6A.
Figure 6E:
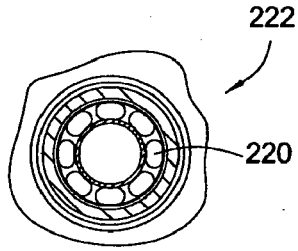
FIG. 6E is an end view of the by-pass apertures illustrated in FIG. 6D.
Figure 6C:
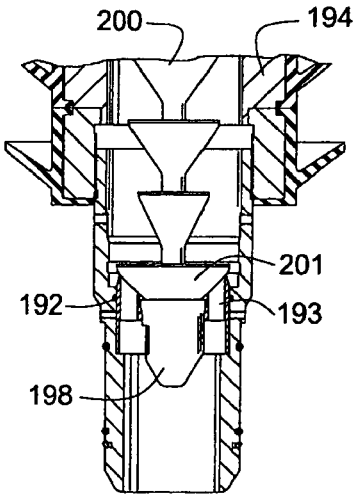
FIG. 6C is a section view of the plug of FIG. 6A showing the flow paths of the plug sealed by a dart.

FIGS. 6A-C illustrate a plug 194 and dart 200 at the end of a run-in string 185. The run-in string transports the pipe into the borehole, provides a fluid path from the well surface and extends at least some distance into the pipe to be cemented. The run-in string provides a flow path therethrough for well fluid during run-in and for cement as it passes from the well surface to the cementing tool at the end of the pipe. An intermediate member 192, disposed within the plug 194 and having a center aperture 197 therethrough, provides a seal for the nose of dart 200 (FIG. 6C) that lands in the plug 194 and seals the flow path therethrough. In order to increase the flow area through intermediate member 192 yet retain the dimensional tolerances necessary for an effective seal between the plug 194 and the dart 200, a number of by-pass apertures 193 are formed around the perimeter of the intermediate member 192. FIG. 6B is a section view of the nose portion 190 of the plug 194 clearly showing the center aperture 197 and by-pass apertures 193 of intermediate member 192. In the preferred embodiment, the by-pass apertures 193 are elliptical in shape.

FIG. 6C is a section view showing the plug 194 with dart 200 seated therein. Center aperture 197 of the intermediate member 192 is sealed by the dart nose 198 and the by-pass apertures 193 are sealed by dart fin 201 once the intermediate member 192 is urged downward in interior of the plug 194 by the dart 200.

Figure 6F:
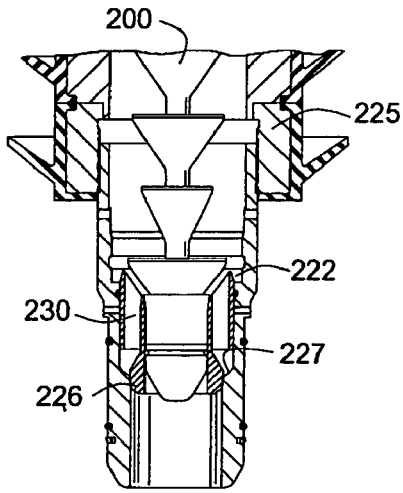
FIG. 6F is a section view of the plug of FIG. 6D showing the flow paths of the plug sealed by a dart.

FIGS. 6D-F illustrate an alternative embodiment in which the by-pass apertures 220 of an intermediate member 222 are sealed when the intermediate member 222 is urged downward in the interior of the plug 225 by the dart 200, thereby creating a metal to metal seal between the plug surface 227 and outer diameter portion 226 of intermediate member 222.

Generally, the tool of the present invention is used in the same manner as those of the prior art. After the well has been drilled to a new depth, the drill string and bit are removed from the well leaving the borehole at least partially filled with drilling fluid. Thereafter, pipe is lowered into the borehole having the cementing tool of the present invention at a downhole end and a run-in tool at an upper end. The entire assembly is run into the well at the end of a run-in string, a string of tubulars typically having a smaller diameter than the pipe and capable of providing an upward flow path for well fluid during run-in and a downward flow path for cement during the cementing operation.

During run-in, the assembly minimizes surge by passing well fluid through the radially spaced apertures 122 of nose portion and into the outer body 110 where it is filtered as it passes into the inner member 135. While some of the fluid will travel up the annulus 130 formed between the outer body 110 and the borehole 115, the tool 100 is designed to permit a greater volume of fluid to enter the interior of the tubular being run into the well. Arrows 182 in FIG. 1B illustrate the path of fluid as it travels between outer body 110 and inner member 135. As the run-in operation continues and the pipe continues downwards in the borehole, the fluid level rises within inner member 135 reaching and filling space 180 between the upper end of the inner member 135 and the baffle collar 125. Prevented by check valve 178 from flowing into the bottom portion of the baffle collar 125, the fluid enters the baffle collar 125 through by-pass channels 175 and by-pass holes 172. Thereafter, the fluid can continue towards the surface of the well using the interior of the pipe and/or the inside diameter of the run-in string as a flow path.

With the nose portion 120 of the tool at the bottom of the well and the upper end located either at the surface well head or near the end of the previously cemented pipe, the pipe may be hung in place, either at the well head or near the bottom of the preceding string through the remote actuation of a hanger, usually using a slip and cone mechanism to wedge the pipe in place. Cementing of the pipe in the borehole can then be accomplished by known methods, concluding with the seating of a plug assembly on or in a baffle collar.

Figure 10C:
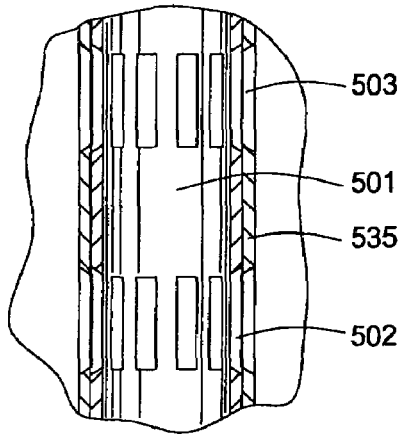
FIG. 10C is an enlarged view of the inner member of the tool showing the relationship between an inner member and an inner sleeve disposed therein.
Figure 10A:
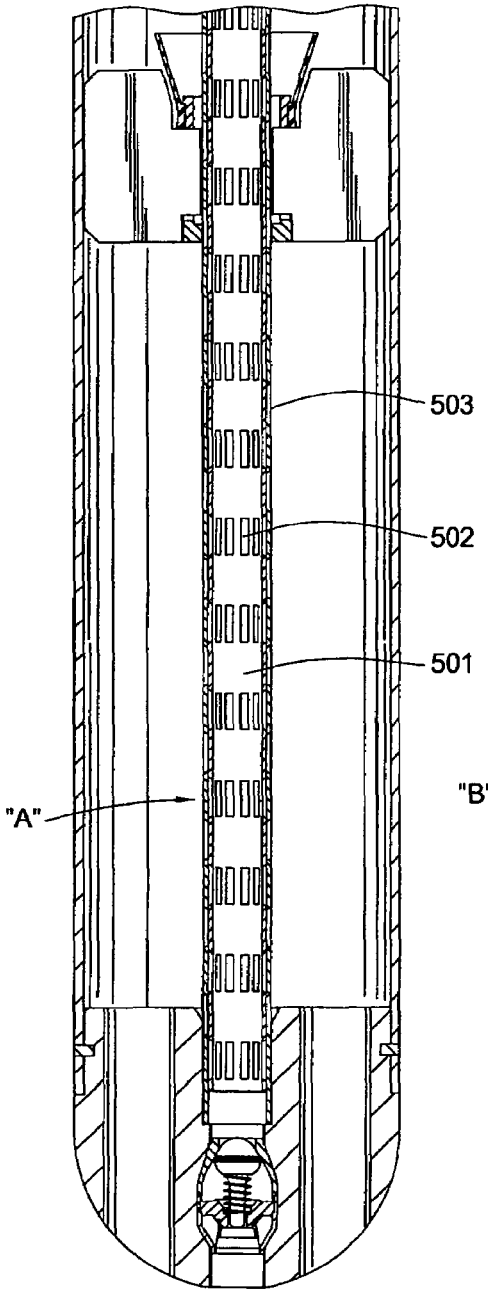
FIGS. 10A and B depict an adjustment feature of the inner member of the tool.
Figure 10B:
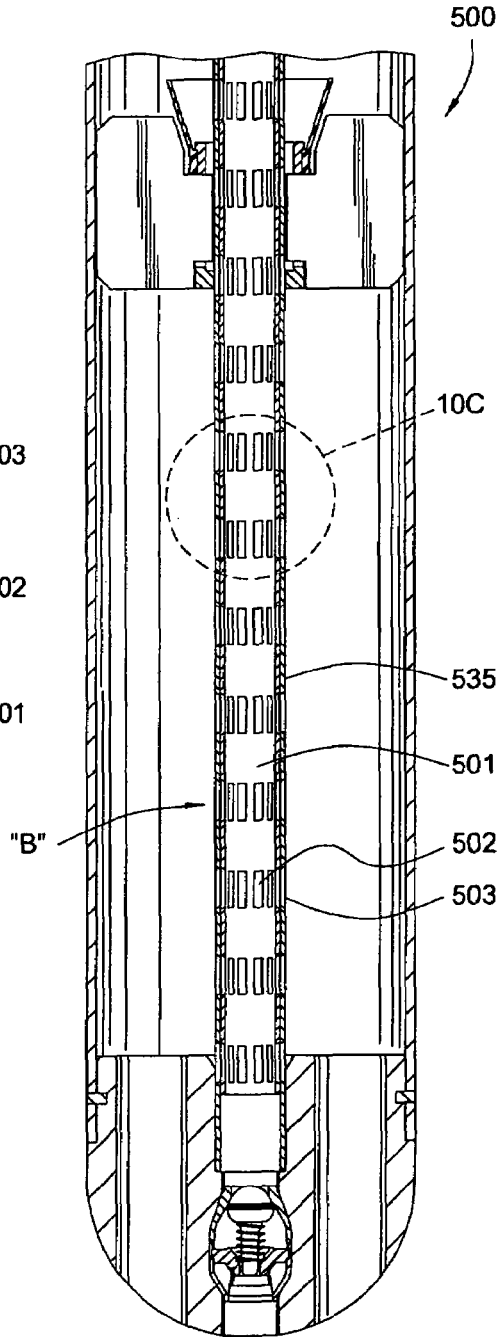

FIGS. 10A-C illustrate an alternative embodiment of the tool 500 wherein the perforations formed in an inner member 535 may be opened or closed depending upon well conditions or goals of the operator. In this embodiment, an inner sleeve 501 is located within the inner member 535. The inner sleeve 501 has perforations 502 formed therein and can be manipulated to cause alignment or misalignment with the mating perforations 503 in the inner member 535. For example, FIG. 10A illustrates the inner member 535 having an inner sleeve 501 which has been manipulated to block the perforations 503 of the inner member 535. Specifically, the perforations of the inner member and the inner sleeve 502, 503 visible in FIG. 10A at point "A" are misaligned, vertically blocking the flow of fluid therethrough. In contrast, FIG. 10B at point "B" illustrates the perforations 502, 503 vertically aligned whereby fluid can flow therethrough. The relationship between the inner sleeve 501 and inner member 135 is more closely illustrated in FIG. 10C, showing the perforations 502, 503 of the inner sleeve 501 and inner member 535 aligned.

Manipulation of the inner sleeve 501 within the inner member 535 to align or misalign perforations 502, 503 can be performed any number of ways. For example, a ball or other projectile can be dropped into the tool 100 moving the inner sleeve 501 to cause its perforations 503 to align or misalign with the perforations 502 in inner member 535. Alternatively, the manipulation can be performed with wireline. While the inner sleeve can be moved vertically in the embodiment depicted, it will be understood that the perforations 502, 503 could be aligned or misaligned through rotational as well as axial movement. For example, remote rotation of the sleeve could be performed with a projectile and a cam mechanism to impart rotational movement.

In operation, the perforations 502, 503 would be opened during run-in to allow increased surge reduction and inner of well fluid as described herein. Once the tool has been run into the well, the perforations 502, 503 could be remotely misaligned or closed, thereby causing the cement to exit the tool directly through the center aperture 124 in the nose portion 120 of the tool, rather than through the perforations and into the annulus 130 between the inner member 135 and the outer body 110.

Figure 11A:
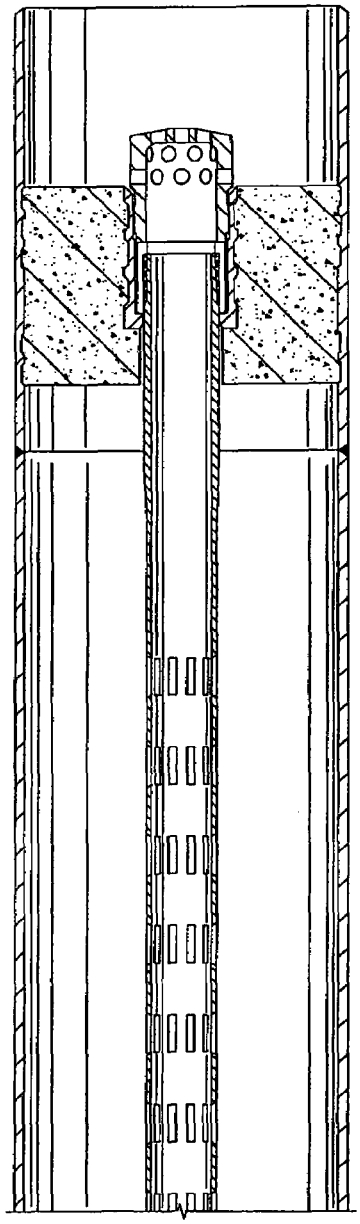
FIGS. 11A and B are section views showing the tool with an additional sediment trapping member disposed therein.
Figure 11B:
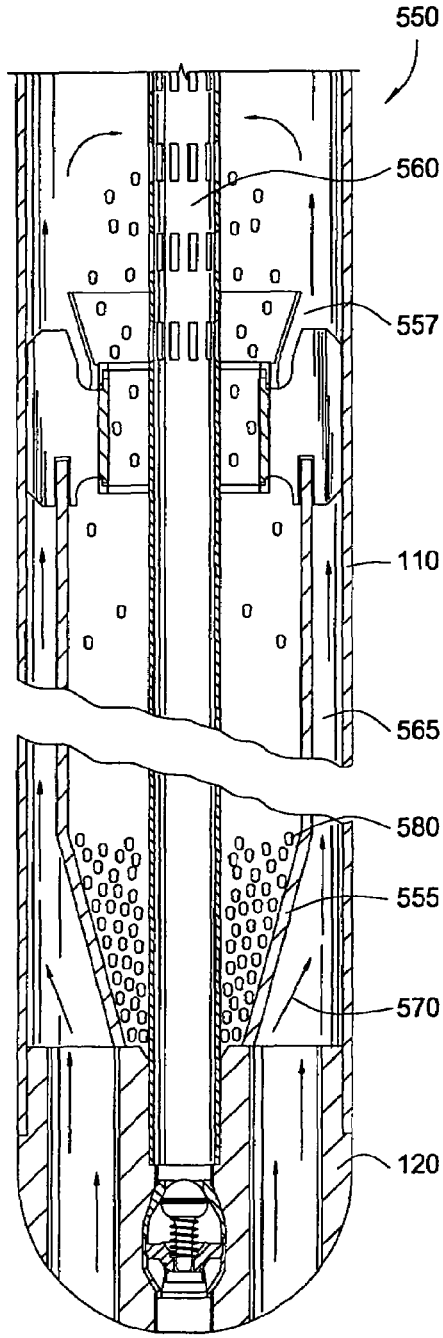

FIGS. 11A and B show an alternative embodiment of a cementing tool 550 including a sediment trap 555 formed between an inner member 560 and an outer body 110. As depicted in FIG. 11B, the sediment trap 555 is a cone-shaped structure having a tapered lower end extending from an upper end of nose portion 120 and continuing upwards and outwards in a conical shape towards outer body 110. An annular area 565 is thereby formed between the outer wall of sediment trap 555 and the inside wall of outer body 110 for the flow of well fluid during run-in. The direction of flow is illustrated by arrows 570 in FIG. 11B. As the tool 550 is run into a well, well fluid and any sediment is routed through annulus 565 and into the upper annulus 575 formed between inner member 560 and outer body 110. As the well fluid is filtered into inner member 560, particles 580 and sediment removed by inner member 560 fall back towards the bottom of the well into the sediment trap 555 where they are retained as illustrated in FIG. 11B. Because that portion of inner member 565 extending through sediment trap 555 includes no inner perforations, contents of the sediment trap 555 remain separated from well fluid as it is filtered into inner member 560.

Figure 12A:
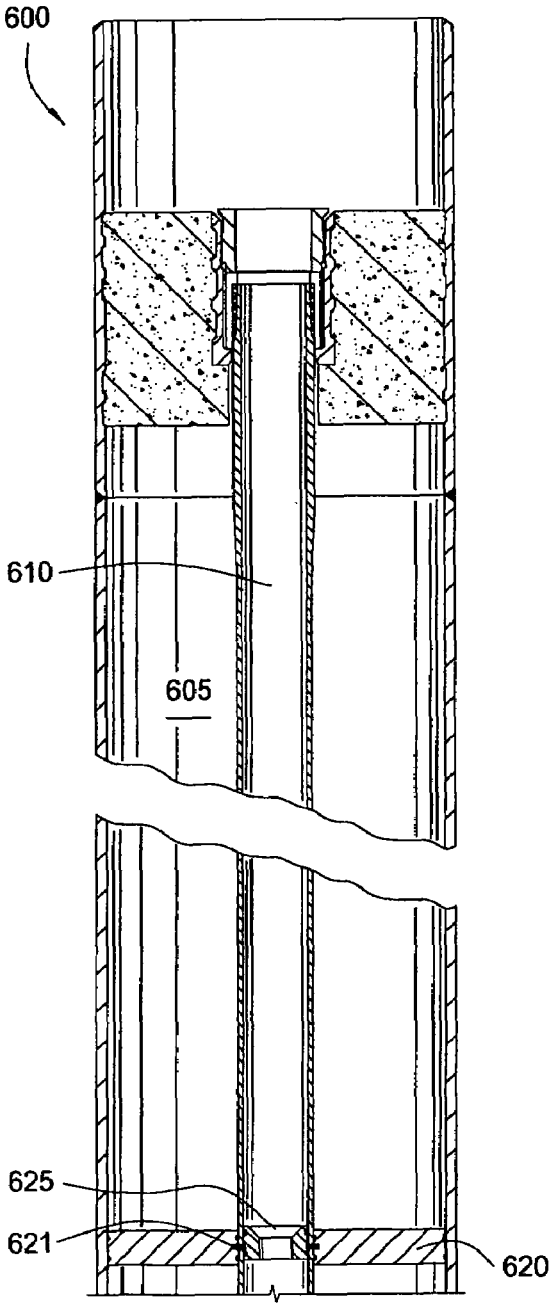
FIGS. 12A and B are section views showing the tool with an atmospheric chamber for evacuating sediment from the borehole.
Figure 12B:
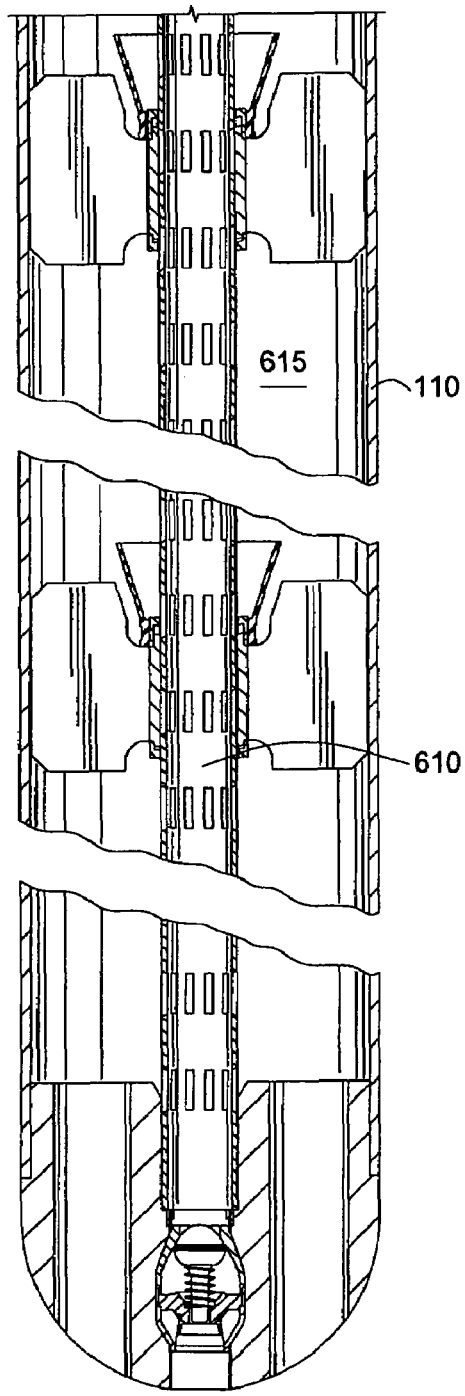

FIGS. 12A and B show an alternative embodiment of a tool 600, including an apparatus for displacing and removing sediment from the bottom of the borehole, thereby allowing the tool 600 to be more accurately placed at the bottom of the borehole prior to cementing. In the tool 600 depicted in FIGS. 12A and B an annular area between the inner member 610 and outer body 110 is separated into an upper chamber 605 and a lower chamber 615 by a donut-shaped member 620. The upper chamber 605, because it is isolated from well fluid and sealed at the well surface, forms an atmospheric chamber as the tool 600 is run into the borehole. Donut-shaped member 620 is axially movable within outer body 110 but is fixed in place by a frangible member 625, the body of which is mounted in the interior of inner member 610. Pins 621 between the frangible member 625 and the donut-shaped member 620 hold the donut-shaped member in place.

After the tool 600 has been run into the borehole, a ball or other projectile (not shown) is released from above the tool 600. Upon contact between the projectile and the frangible member 625, the frangible member is fractured and the donut-shaped member 620 is released. The pressure differential between the upper 605 and lower 615 chambers of the tool causes the donut-shaped member 620 to move axially towards the well surface. This movement of the donut-shaped member 620 creates a suction in the lower chamber 615 of the tool which causes loose sediment (not shown) to be drawn into the lower chamber 615. In this manner, sediment is displaced from the borehole and the tool can be more accurately placed prior to a cementing job.

FIGS. 13A and B illustrate yet another embodiment of the tool 650, wherein a remotely locatable, atmospheric chamber 655 is placed in the interior of inner member 660. As with the embodiment described in FIGS. 12A and B, the annular area between inner member 660 and outer body 110 is divided into an upper 665 and lower 670 chambers with a donut-shaped member 675 dividing the two chambers. That portion of the inner member 680 extending through upper chamber 665 is not perforated but includes only a plurality of ports therearound. In this embodiment, pressure in the upper and lower chambers remain equalized during run-in of the tool into the borehole. Atmospheric chamber 655 is contained within a tool 677. After run-in, atmospheric chamber tool 677 is lowered into the borehole by any known method including a separate running string or wireline. The atmospheric chamber tool 677 lands on a shoulder 682 formed in the interior of the inner member 680 at which point apertures 684 in the atmospheric chamber tool 677 and apertures 686 in the inner member 680 are aligned. In order to actuate the atmospheric chamber tool 850 and create a pressure differential between the upper 655 and lower 670 chambers, the atmospheric chamber tool 677 is urged downward until the apertures 684 and 685 are aligned. Upon alignment of the various apertures, the upper chamber 665 is exposed to the atmospheric chamber 655 and a pressure differential is created between the upper and lower chambers. The pressure differential causes the donut-shaped member 675 to move axially towards the top of the tool because the hydrostatic pressure in the lower chamber is greater than the in the upper chamber. Therefore, a suction is created in the lower chamber 670 which evacuates loose sediment from the borehole and improves positioning of the tool in the borehole for the cementing job.

In another embodiment, a swabbing device (not shown) is run-into the pipe above the tool or may be run-into the inner member 135 of the tool 100 to a location above the perforations 160. The swabbing device is then retracted in order to create a suction at the downhole end of the tool and urge sediment into the tool from the bottom of the borehole. The swabbing device is well known in the art and typically has a perimeter designed to allow fluid by-pass upon insertion into a tubular in one direction but expand to create a seal with the inside wall of the tubular when pulled in the other direction. In the present embodiment, the swabbing device is inserted into the well at the surface and run-into the well to a predetermined location after the pipe assembly has been run-into the well, but before cementing. The swabbing device is then pulled upwards in the borehole creating a suction that is transmitted to the downhole end of the tool, thereby evacuating sediment from the borehole.

In yet another embodiment, the tool 100 is run-into the well with the perforations 502 and 503 misaligned. As the tool is run into the borehole with the pipe assembly, a pressure differential develops such that the hydrostatic pressure in the borehole is greater than the pressure in the pipe and/or the tool. When the perforations of the inner member are remotely opened at the pressure differential between the inner member and the fluid in the borehole creates a suction and sediment in the borehole is pulled into the tool and out of the well.

Figure 14A:
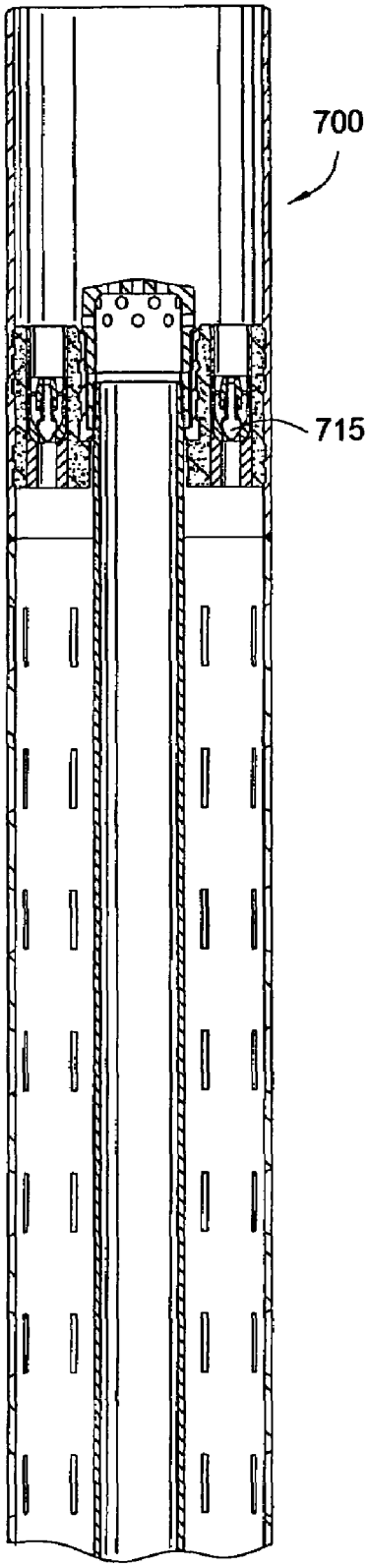
FIGS. 14A and B are section views showing an alternative embodiment of the tool.

FIGS. 14A and B depict a tool 700, another embodiment of the present invention. In this embodiment, the outer body 705 is perforated along its length to allow the flow of well fluid therethrough during run-in of the tool into a borehole. The flow of fluid is indicated by arrows 710. Upon filling the outer body, the well fluid passes through two one-way check valves 715*a,b* into a baffle collar and thereafter into a pipe thereabove (not shown). The check valves 715 prevent fluid from returning into the outer body 705. In this embodiment, the inner member 720 is non-perforated and is isolated from the annulus between the inner member and outer body. In operation, the inner member 720 carries cement from its upper end to its lower end where the cement passes through a lower check valve 725 and into the annular area between the outer body and the borehole (not shown).

Figure 14B:
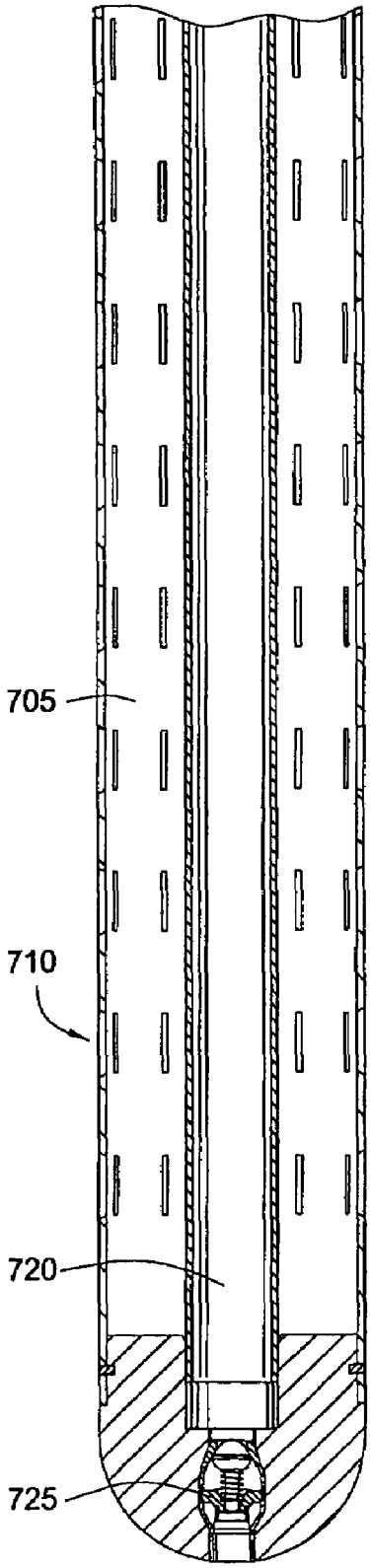
Figure 15A:
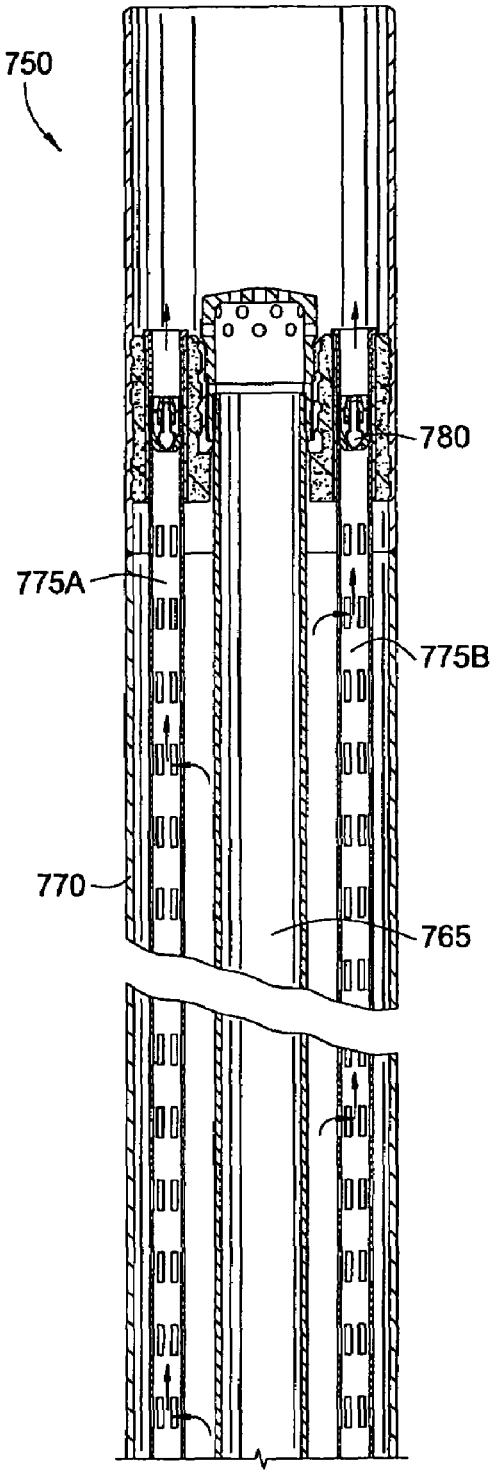
FIGS. 15A and B are section views showing an alternative embodiment of the tool.
Figure 15B:
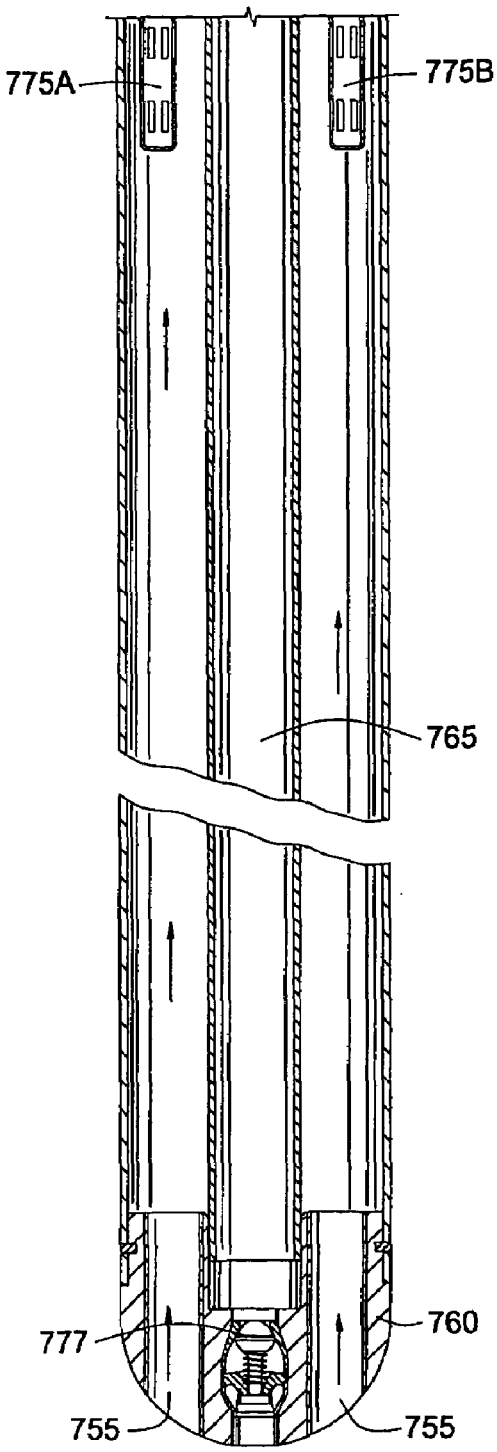

FIGS. 15A and B are section views of another embodiment of the present invention depicting a tool 750. In this embodiment, well fluid travels through apertures 755 in the nose portion 760 of the tool 750 and into an annular area created between the inner member 765 and the outer body 770. From this annular area, fluid is filtered as it passes into perforated filtering members 775*a,b* which remove sand and sediment from the fluid before it passes through check valves 780 to a baffle collar and into a pipe. The check valves prevent fluid from returning into the filtering members 775*a,b*. Like the embodiment of FIG. 14, inner member 776 is a non-perforated member and provides a flow path for cement through a check valve at the downhole end of the tool and into the annulus to be cemented.

Figure 16A:
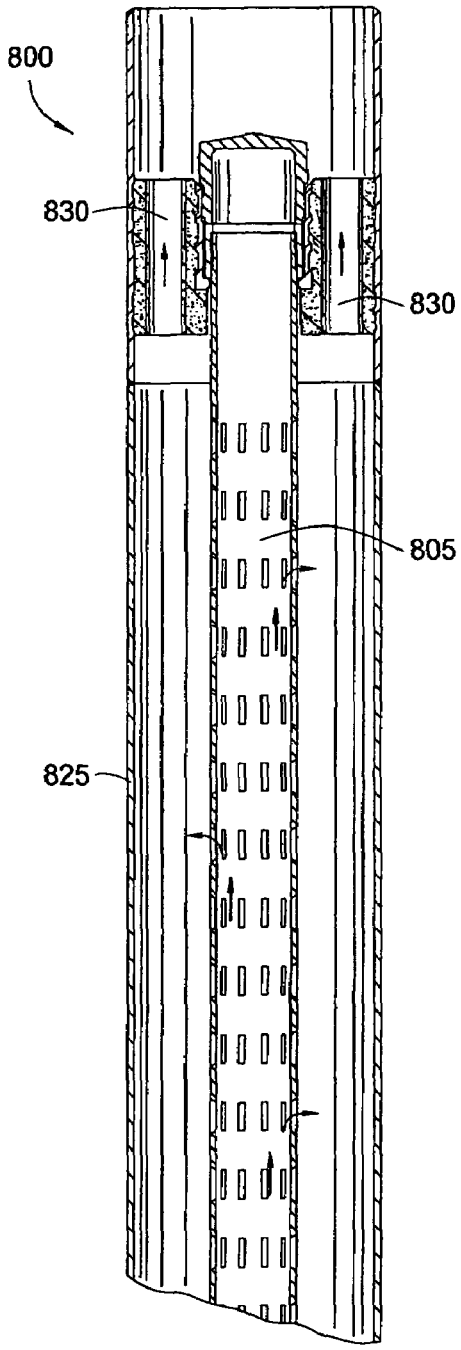
FIGS. 16A and B are section views showing an alternative embodiment of the tool.
Figure 16B:
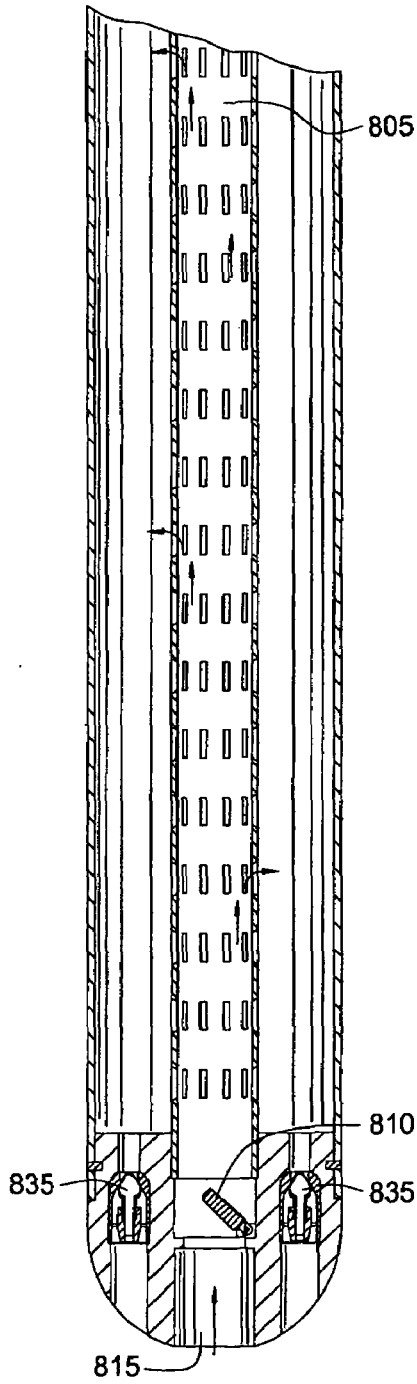

FIGS. 16A and B are section views of tool 800, another embodiment of the present invention. During run-in of the tool into the borehole, well fluid enters a center aperture 815 at a downhole end of an inner member 805 passing through a flapper valve 810 located in the center aperture 815 which prevents well fluid from subsequently exiting the center aperture. Well fluid is filtered as it passes from the inside of the inner member 805 to the outer body 825. The fluid continues upwards through channels 830 formed in the upper portion of the tool and into a pipe thereabove. Subsequently, cement is urged into the tool through the channels 830 and travels within the outer body 825 to the bottom of the tool where it exits through one-way check valves 835.

Figure 17:
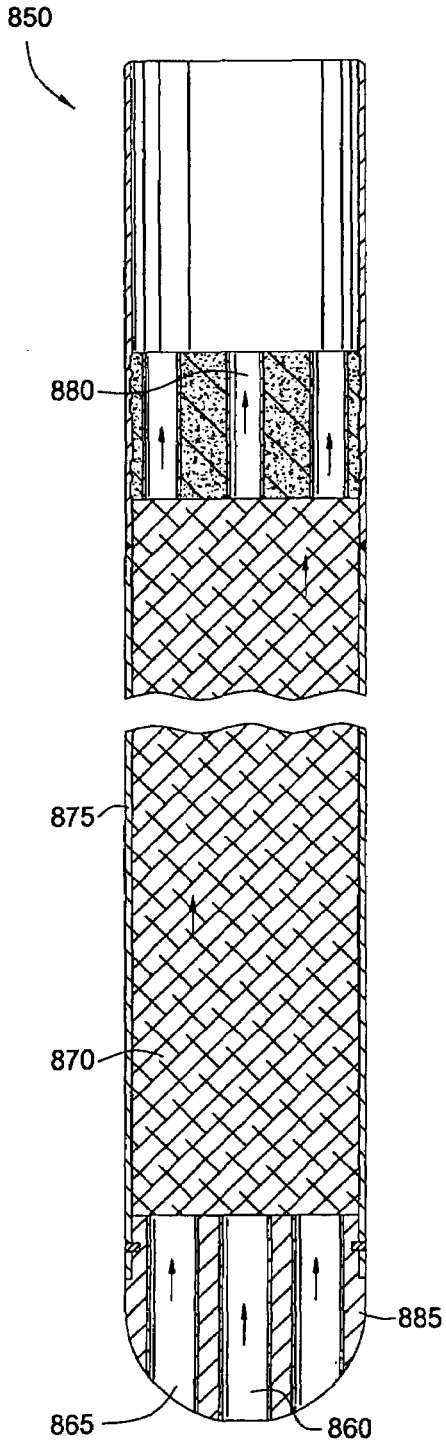
FIG. 17 is a section view showing an alternative embodiment of the tool.

FIG. 17 is a section view of tool 850, another embodiment of the present invention. In this embodiment, well fluid enters nose portion 855 of tool through center aperture 860 and radial apertures 865 and is filtered through a filter medium 870 such as packed fiber material, which is housed within an outer body 875. After being filtered through the filter medium, the well fluid passes through the upper portion of the tool, through channels 880 formed in the upper portion of the tool 850 and then through a baffle collar and into a pipe thereabove. Thereafter, the cement is introduced into the tool through the channels 880 and urged through the filter material to the bottom of the tool where it exits center 860 and radial apertures 865 into the annular area to be cemented.

Figure 18:
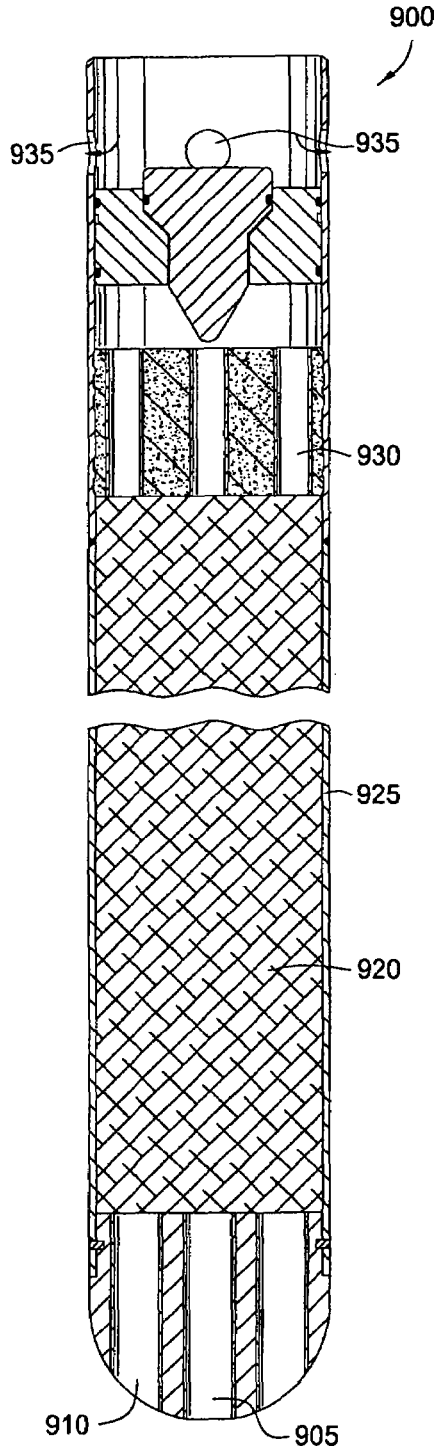
FIG. 18 is a section view showing an alternative embodiment of the tool.

FIG. 18 is a section view of tool 900, another embodiment of the present invention. Like the embodiment shown in FIG. 17, during run-in well fluid enters center 905 and side 910 apertures at the bottom of the tool and is then filtered through woven fiber material 920 housed in the outer body 925. The well fluid passes through a baffle collar and into pipe thereabove through channels 930 formed at the upper end of the tool. In this embodiment, unlike the embodiment described in relation to FIG. 17, the cement introduced into the annulus of the borehole by-passes the filter material 920 in the outer body 925. Specifically, ports 935 formed in the tool above the channels 930 provide an exit path for cement. During run-in, the ports 935 are sealed with a moveable sleeve allowing well fluid to pass from the filter material of the tool into the pipe thereabove. After the tool is run into the well, a plug is landed in the sleeve and urges the sleeve downward, thereby exposing the ports 935 which provide fluid communication between the inside of the tool and the borehole therearound. Because the cement travels through the open ports 935 during the cementing job, there is no need to pump the cement through the woven fiber material 920 in the outer body 925.

Figure 19A:
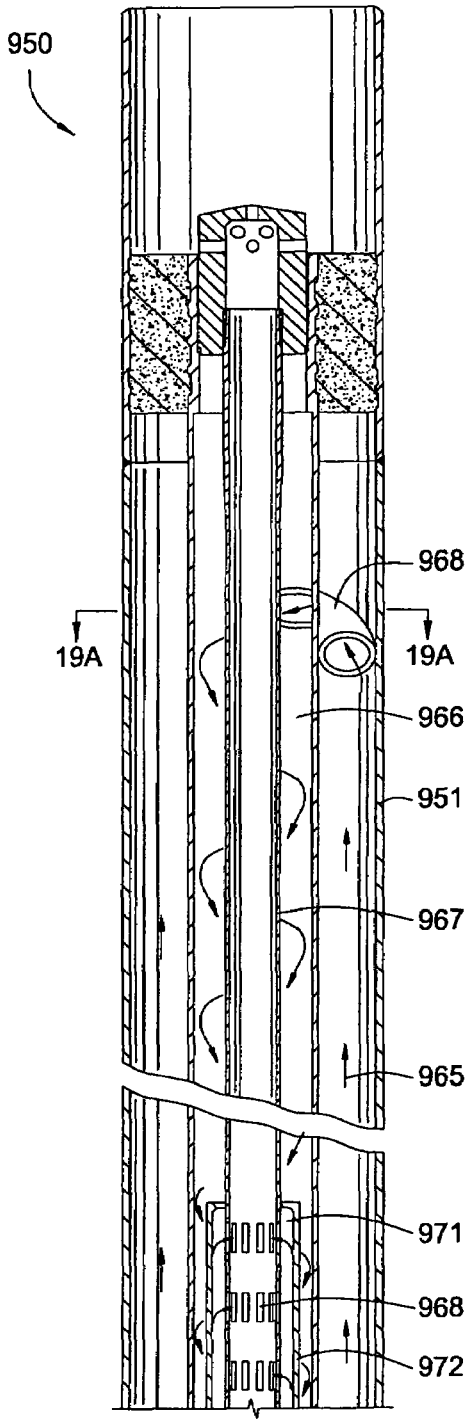
FIGS. 19A, B and C are section views showing an alternative embodiment of the invention.
Figure 19B:
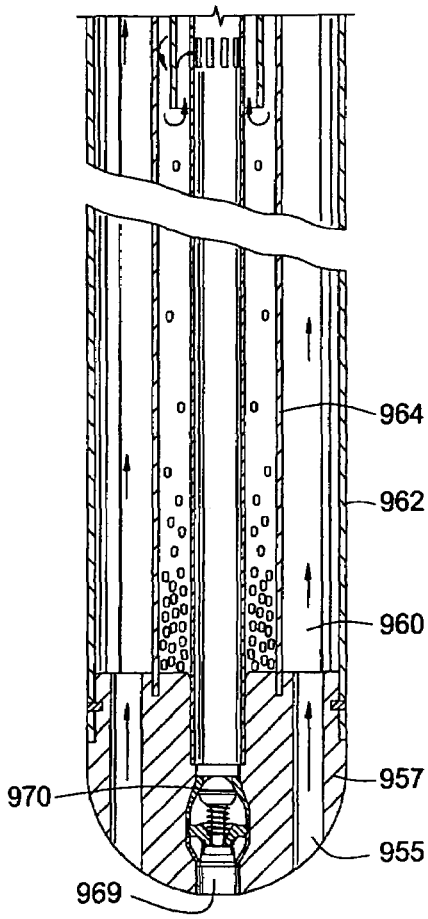
Figure 19C:
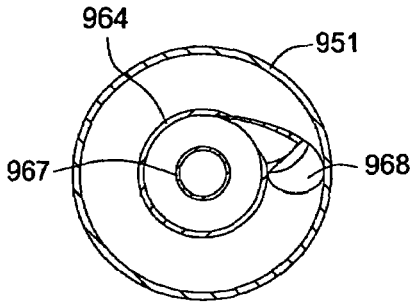

FIGS. 19A, B and C are section views of an alternative embodiment of the present invention depicting a tool 950 for reducing surge during run-in and having a vortex separator for filtering sediment from well fluid. The vertex separator is well known in the art and operates by separating material based upon density. In the present invention, the fluid having a first density is separated from particles having a second density. In this embodiment, fluid enters the nose portion 957 of the tool through apertures 955 formed on each side of the nose portion. Thereafter, the fluid travels through an annular area 960 formed between the outer body 962 and intermediate member 964. The path of the fluid is demonstrated by arrows 965. At the upper end of annulus 960, the fluid enters swirl tube 968 where it is directed to another annular area 966 formed between the inner wall of intermediate 964 and inner member 967. As the fluid travels downwards in annulus 966, it enters a third annular area 971 defined by the outer wall of the inner member 967 and an inner wall of an enclosure 972 open at a lower end and closed at an upper end. The fluid is filtered as it enters perforations 968 formed in inner member 967 and thereafter, filtered fluid travels upwards in inner member 967 through a baffle collar (not shown) and into a pipe thereabove. In the embodiment shown in FIG. 19B, any sediment traveling with the fluid through annular area 966 is separated from the fluid as it enters inner member 967 through perforations 968. The sediment falls to the bottom of annular area 966 as illustrated in FIG. 19. Cement is thereafter carried downward through inner member 967, exiting center aperture 969 through one-way check valve 970.

Figure 20A:
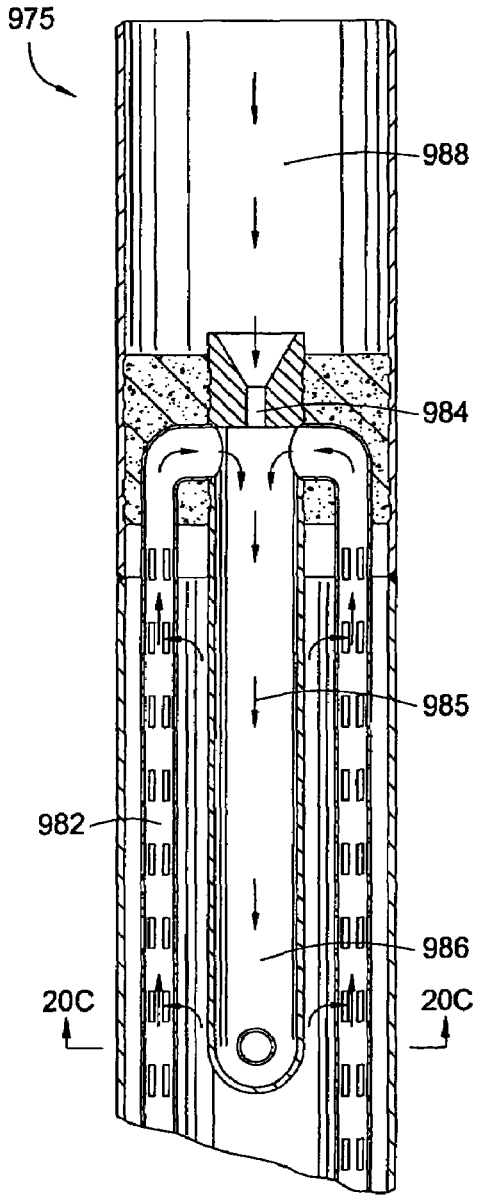
FIGS. 20A, B and C are section views showing an alternative embodiment of the invention.
Figure 20B:
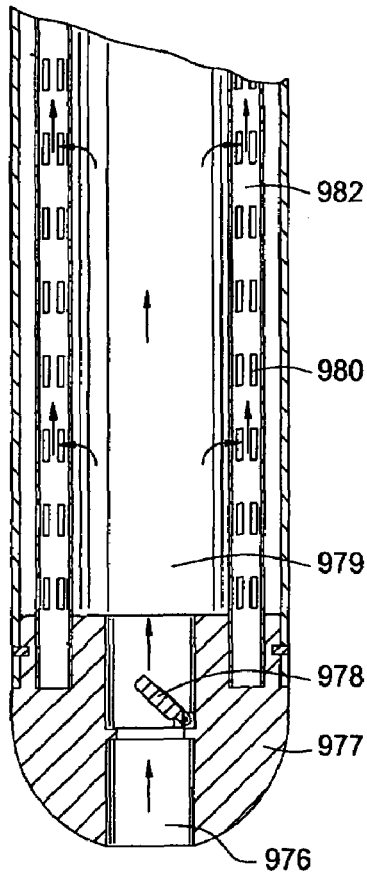
Figure 20C:
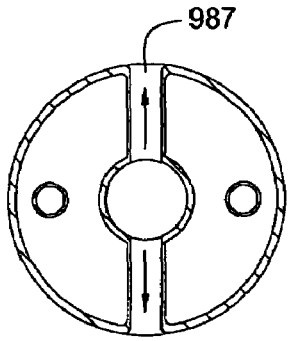

FIG. 20 is an alternative embodiment of the invention illustrating a tool 975 that includes a venturi jet bailer formed within. This embodiment is particularly effective for removing or bailing sediment encountered at any point in a wellbore. During run-in, well fluid enters the tool through center aperture 976 formed in nose portion 977. Flapper valve 978 prevents fluid from returning to the wellbore. After entering the tool, fluid is filtered through apertures 980 formed along the length of two filtering members 982. Thereafter, filtered fluid travels into a pipe 988 above the tool through nozzle 984, in order to reduce pressure during run-in of the tool.

Wherever sediment is encountered in the wellbore, the tool can be operated as a bailer by pressurizing fluid above the tool and causing a stream of high velocity, low pressure fluid to travel downward through nozzle 984. The flow of fluid during the bailing operation is illustrated by arrows 985. Specifically, fluid travels through the nozzle and into diverter 986 where the fluid is directed out of the tool through ports 987 and into an annular area outside of the tool (not shown). As the high velocity fluid is channeled through nozzle 984, a low pressure area is created adjacent the nozzle and a suction is thereby created in the lower portion of the tool. This suction causes any sediment present at the lower end of the tool to be urged into the tool through flapper valve 978. The sediment is prevented from falling back into the wellbore by the flapper valve and remains within the interior of the tool. Cementing is thereafter performed by pumping cement through the nozzle 984, into diverter 986 and into the annular area to be cemented (not shown) through ports 987.

While foregoing is directed to the preferred embodiment of the present invention, other and further embodiments of the invention may be devised without departing from the basic scope thereof, and the scope thereof is determined by the claims that follow.

The invention claimed is:

1. A tool for use in a tubular string comprising:
- a non-perforated tubular inner member having first and second ends;
- a tubular outer member having an end; and
- a nose formed integrally with or disposed on the end of the outer member and disposed on the second end of the inner member,
- wherein:
  - at least a portion of the outer member is perforated for filtering wellbore particulates, and
  - the inner member is made from a rigid, drillable material.

2. The tool of claim 1, further comprising a cap disposed over the first end of the inner member, wherein the cap is perforated for filtering wellbore particulates.

3. The tool of claim 1, wherein the nose comprises a channel therethrough, the channel providing fluid communication between the inner member and the outside of the tool and a check valve is disposed in the channel.

4. The tool of claim 1, wherein the nose portion isolates the end of the outer member from outside of the tool.

5. The tool of claim 1, further comprising a ring disposed in the outer member and around the inner member, proximate to the first end of the inner member, the ring coupling the outer and inner members together.

6. The tool of claim 5, wherein the ring comprises a channel therethrough, the channel providing fluid communication between upper and lower portions of the outer member and a check valve is disposed in the channel.

7. The tool of claim 5, wherein the ring axially and radially couples the inner member with the outer member.

8. The tool of claim 1, wherein substantially all of the outer member is perforated.

9. A method of using a tool in a wellbore, comprising:
- disposing the tool onto an end of a casing or liner string, the tool comprising:
  - a non-perforated tubular inner member, and
  - a tubular outer member, wherein at least a substantial portion of the outer member is perforated;
- running the casing or liner string into a wellbore, thereby flowing wellbore fluid through the outer member while filtering particulates from the wellbore fluid; and
- cementing the casing or liner string and the outer member to the wellbore.

10. The method of claim 9, further comprising:

drilling through the inner member.

11. The method of claim 9, wherein the wellbore is a predrilled wellbore and the wellbore fluid is drilling mud.

12. The method of claim 9, wherein at least a portion of the outer member is perforated and the wellbore fluid is filtered by flowing the wellbore fluid through the outer member.

13. The method of claim 12, wherein substantially all of the outer member is perforated.

14. The method of claim 9, wherein filtered wellbore fluid flows through the casing or liner string towards a surface of the wellbore while running the casing or liner string.

15. The method of claim 9, further comprising preventing fluid communication between the tool and the casing or liner string.

16. The method of claim 15, wherein cementing the casing or liner string comprises injecting cement through the casing or liner string and the inner member, wherein preventing fluid communication occurs after injecting cement.

17. A tool for use in a tubular string comprising:

a non-perforated tubular inner member having first and second ends;

a tubular outer member having an end; and a cap disposed over the first end of the inner member, wherein:

at least a portion of the outer member is perforated for filtering wellbore particulates, the inner member is made from a drillable material, and the cap is perforated for filtering wellbore particulates.

* * * * *